US006847295B1

(12) United States Patent
Taliaferro et al.

(10) Patent No.: US 6,847,295 B1
(45) Date of Patent: Jan. 25, 2005

(54) ANTI-ABDUCTION SYSTEM AND METHOD

(76) Inventors: Vernice Doyle Taliaferro, 1400 E. University Dr., Apt. 3219, Denton, TX (US) 76209-2250; Kevin Mark Klughart, 2516 Lillian Miller Pkwy., Suite 115, Denton, TX (US) 76210-7205

( * ) Notice: Subject to any disclaimer, the term of this patent is extended or adjusted under 35 U.S.C. 154(b) by 0 days.

(21) Appl. No.: 10/820,901

(22) Filed: Apr. 8, 2004

(51) Int. Cl.[7] ..... G08B 1/08

(52) U.S. Cl. ..... 340/539.13; 340/539.1; 340/539.11; 340/539.15; 340/539.21; 340/573.1; 340/573.4

(58) Field of Search ..... 340/539.13, 539.1, 340/539.11, 539.15, 539.21, 539.32, 573.1, 573.4

(56) References Cited

U.S. PATENT DOCUMENTS 4,899,134 A 2/1990 Wheeless, Jr.
5,629,678 A 5/1997 Gargano et al.
5,652,570 A * 7/1997 Lepkofker ..... 340/573.4
5,699,555 A 12/1997 Schunter
5,771,002 A * 6/1998 Creek et al. ..... 340/539.21
5,996,380 A 12/1999 Harris
6,263,710 B1 7/2001 Harris
6,396,403 B1 * 5/2002 Haner ..... 340/573.4
6,529,131 B2 * 3/2003 Wentworth ..... 340/573.1
6,747,555 B2 * 6/2004 Fellenstein et al. ..... 340/524

* cited by examiner

*Primary Examiner*—Daryl C. Pope
(74) *Attorney, Agent, or Firm*—Kevin Mark Klughart

(57) ABSTRACT

An anti-abduction system and method is disclosed which utilizes a radio frequency transceiver attached to a slave to communicate with a corresponding master transceiver to detect and prevent abductions, which may be advantageously applied to situations in which child abduction is a possibility. The disclosed system and method utilizes communication protocols to notify the master of the proximal locality of the slave unit and any spatial deviation of the slave from the master. Utilization of varying strength transceiver signaling between the master and slave permits the distance between the master and slave to be approximated. Additionally, the slave may contain an optional heartbeat monitor to detect and report situations in which the device is removed from the potential abduction victim. The present invention may be generally targeted towards preventing child abductions, but has applications as an anti-terrorist device in preventing kidnappings of political persons and other innocents by terrorist groups and the like.

20 Claims, 12 Drawing Sheets

*Prior Art*

0200

0202
0222
0221
0201
Local
Proximity
Protocol
0210
0211
0212
SEPARATION
ACQUISITION
0203
Master
Alerted
0213
Global
Alert
Separation
Alerted
ABDUCTION
0214
Local
Search
Local
Security
Notified
Alert
Capture
0203
0220
0215
Community
Search
Law
Enforcement
Notified
Alert
Capture
Image/
Video
0216
Regional
Search
AMBER
Alert
Capture

ANTI-ABDUCTION SYSTEM AND METHOD

CROSS REFERENCE TO RELATED APPLICATIONS

Not Applicable

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention relates generally to the prevention and detection of abduction scenarios involving slave target individuals, which may include children and the like as well as adults who may be placed in situations where kidnapping and other terrorist events may occur. The goal of the present invention is to provide a system and method to minimize the possibility of abduction or alternatively permit recovery of persons who have been abducted as a result of kidnapping, child molestation, or other terrorist events.

The present invention has particular application to the issues regarding missing and sexually exploited children. This is a nationwide problem in the United States that encompasses a variety of categories of missing children and other individuals that have simply disappeared from their families and friends. As stated by the National Center for Missing & Exploited Children (www.missingkids.com):

"The problem of missing children is complex and multi-faceted. There are different types of missing children including family abductions; endangered runaways; nonfamily abductions; and lost, injured, or otherwise missing children. The best national estimates for the number of missing children are from incidence studies conducted by the U.S. Department of Justice's Office of Juvenile Justice and Delinquency Prevention.

To date two such studies have been completed. The first *National Incidence Studies of Missing, Abducted, Runaway, and Thrownaway Children* (NISMART-1) was released in 1990, and the second, known as NISMART-2, was released in October 2002. According to NISMART-2 research, which studied the year 1999, an estimated 797,500 children were reported missing; 58,200 children were abducted by nonfamily members; 115 children were the victims of the most serious, long-term nonfamily abductions called "stereotypical kidnappings"; and 203,900 children were the victims of family abductions."

The present invention is particularly advantageous when applied to situations where these children are abducted either by family members or nonfamily members. According to the statistics from NISMART-2 detailed above, this encompasses over 250,000 children per year.

DESCRIPTION OF THE PRIOR ART (0100)

The prior art is generally illustrated in FIG. 1 (0100), which illustrates a typical child abduction scenario and the techniques used by law enforcement to address this event. Here, a child target (0101) (referred to as the slave target (0201) in the present invention) and their parent (0102) (referred to as the master monitor (0202) in the present invention context) are in close proximity to each other (0110), such as on a shopping trip to the mall. In these scenarios, the parent (0102) is generally separated from the child (0101) and acquired by a kidnapper, child molester, or the like (0103). Generally, the major issue in these situations is that the separation is not immediately detected by the parent, permitting the abductor to acquire the child (0120) and escape the general proximity of the parent.

Once the separation has been detected by the parent, an escalating series of contacts is made with local mall security, law enforcement, and possibly a regional AMBER alert. At each stage the number of individuals notified increases, but in general there is significant lost time in the transition between notification of local security and that of a more general and spatially expanding law enforcement network.

As seen in FIG. 1, the critical time sequencing (0111, 0112, 0113, 0114, 0115, 0116) indicates a significant loss of time in both determining that the child has been lost, but also in determining that the child has been taken by a dangerous entity.

A variety of attempts at preventing child abductions have been posited by the prior art, the majority of which rely on physical restraint of the child to preserve security. These include U.S. Pat. No. 4,899,134 for NEWBORN ANTI-THEFT DEVICE issued to Clifford R. Wheeless, Jr. on Feb. 6, 1990; U.S. Pat. No. 5,699,555 for CHILD'S WAISTBELT AND LEASH FOR PROTECTION AGAINST ABDUCTION OF A CHILD issued to Christine K. Schunter on Dec. 23, 1997; U.S. Pat. No. 5,996,380 for ANTI-ABDUCTION DEVICE issued to Christopher L. Harris on Dec. 7, 1999; and U.S. Pat. No. 6,263,710 for ANTI-ABDUCTION DEVICE issued to Christopher L. Harris on Jul. 24, 2001. Other technologies incorporating tracking devices as described in U.S. Pat. No. 5,629,678 for PERSONAL TRACKING AND RECOVERY SYSTEM issued to Paul A. Gargano, et. al. on May 13, 1997 do not incorporate the teachings of the present invention as to the prevention of abductions and the like.

OBJECTIVES OF THE INVENTION

Accordingly, the objectives of the present invention are (among others) to circumvent the deficiencies in the prior art and affect the following objectives:

(1) Permit notification of separation of slave targets from their master monitors prior to abduction by third parties.

(2) Permit notification of emergency conditions by slave targets to master monitors, including but not limited to potential abduction events.

(3) Permit detection of the health/safety of the slave target and transmission of this information to the master monitor.

(4) Prevent abductions by providing for immediate notification of potential abduction situations to security and law enforcement officials.

(5) Locate abducted slave targets by law enforcement once abduction has taken place.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

The present invention system is generally illustrated in FIG. 2. Referring to FIG. 2 (0200), the general concept behind the present invention is to have a pair of transceivers, termed the slave transceiver (0221) proximal to the slave target (0201) and a corresponding master transceiver (0222) in close proximity to the master monitor (0202). These devices may have a variety of form factors, but in some preferred embodiments the slave transceiver may constitute a wristwatch style form factor and the master transceiver may be larger, and similar to a small transistor radio (approximately the size of a bar of soap).

In this context, the master transceiver (0222) and the slave transceiver (0221) communicate using a low power transmission protocol which only permits reception by the other transceiver within a limited spatial distance. As the distance between the master monitor (0202) and the slave target (0201) is increased as the slave target (0201) is acquired by a kidnapper or abductor (0203), the communication between the transceivers (0221, 0222) is disrupted. This triggers a series of protocols to attempt reestablishment of communication between the transceivers (0221, 0222) and if this fails, notification of lost contact to the master monitor (0202).

Once contact between the transceivers (0221, 0222) is disrupted, the slave transceiver (0221) enters a series of protocols attempting to reestablish contact with the master transceiver (0222). If this fails, an escalating series of panic broadcasts are transmitted by the slave transceiver (0221) which are directed at corresponding transceivers possessed by local security officials, law enforcement, and potentially even nationwide AMBER alert systems. Since each slave transceiver (0221) is uniquely serialized, the transmission of this information to law enforcement permits an association between the alert messages being transmitted by the slave transceiver (0221) and a database containing photographs, physical description, fingerprints, and DNA for the slave target (0201). This information permits a rapid response to be affected to reacquire the slave target (0201) by local security personnel or law enforcement.

Enhancements to this disclosed invention also include scenarios where either or both the master transceiver and the slave transceiver are equipped with Global Positioning System (GPS) receivers which permit transmission of the exact location of each unit to its corresponding master or slave transceiver. This addition of GPS information permits one or more of the transceivers to be used by the master monitor (0202) or slave target (0201) to locate the other party, as in a mall setting or in situations where law enforcement are attempting to locate a victim of abduction or kidnapping.

BRIEF DESCRIPTION OF THE DRAWINGS

For a fuller understanding of the advantages provided by the invention, reference should be made to the following detailed description together with the accompanying drawings wherein.

Figure 1:
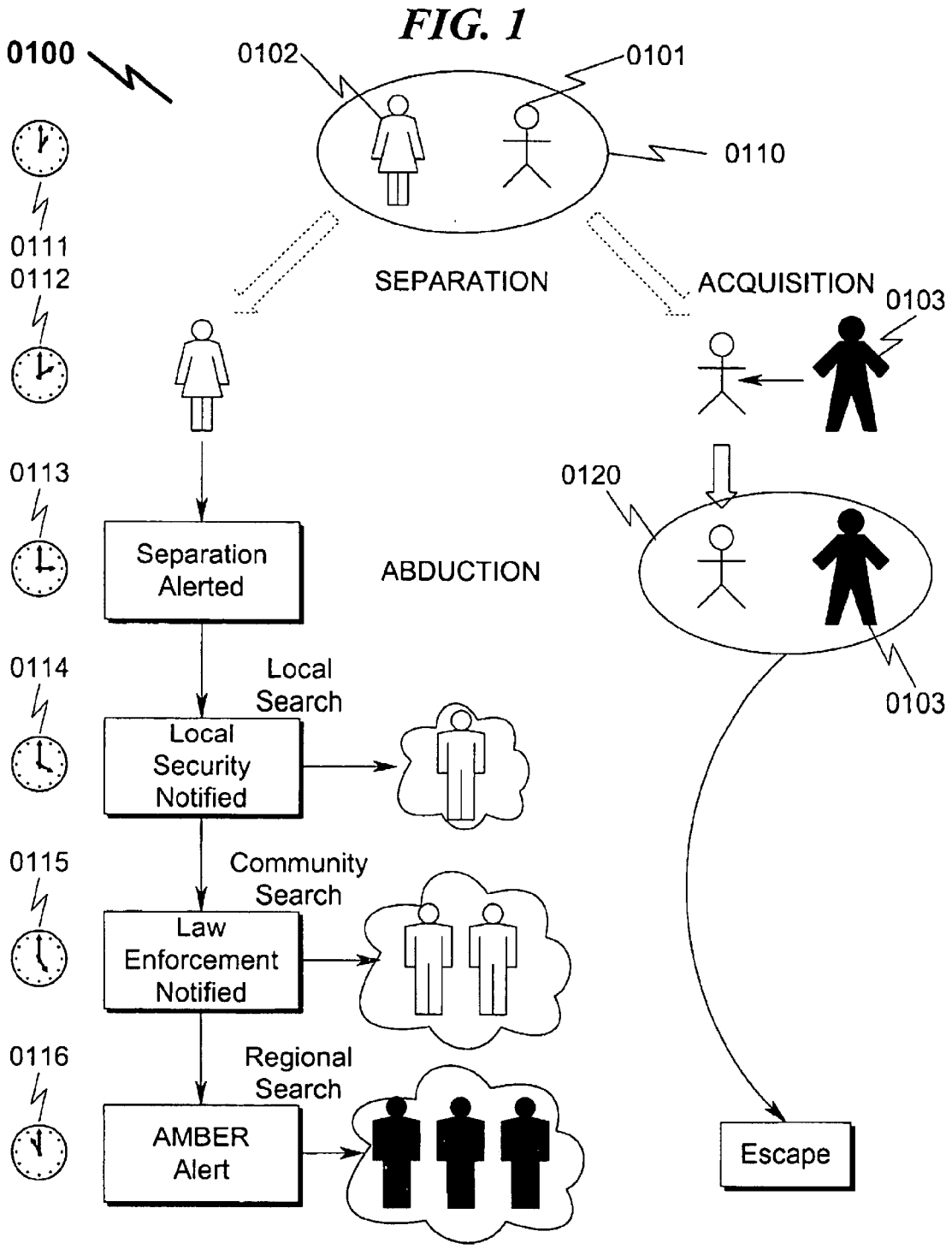
FIG. 1 illustrates a prior art abduction scenario.

These drawings also illustrate the use of the present invention in drilling earthen holes for utility pole placement, installation of a utility pole, and installation of associated utility pole transformer equipment.

DESCRIPTION OF THE PRESENTLY PREFERRED EXEMPLARY EMBODIMENTS

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of an ANTI-ABDUCTION SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Form Factor Not Limitive

The present invention may be generally applied to situations in which the slave transceiver is configured in the form factor of a wristwatch, but other embodiments are equally possible, including ankle bracelets, necklaces, fashion accessories, or incorporation into clothing. Similarly, nothing in the teaching of the present invention limits the form factor of the master transceiver. One skilled in the electrical arts will no doubt find other applications for the teachings of the present invention.

Exemplary System Embodiment (0200)

Figure 2:
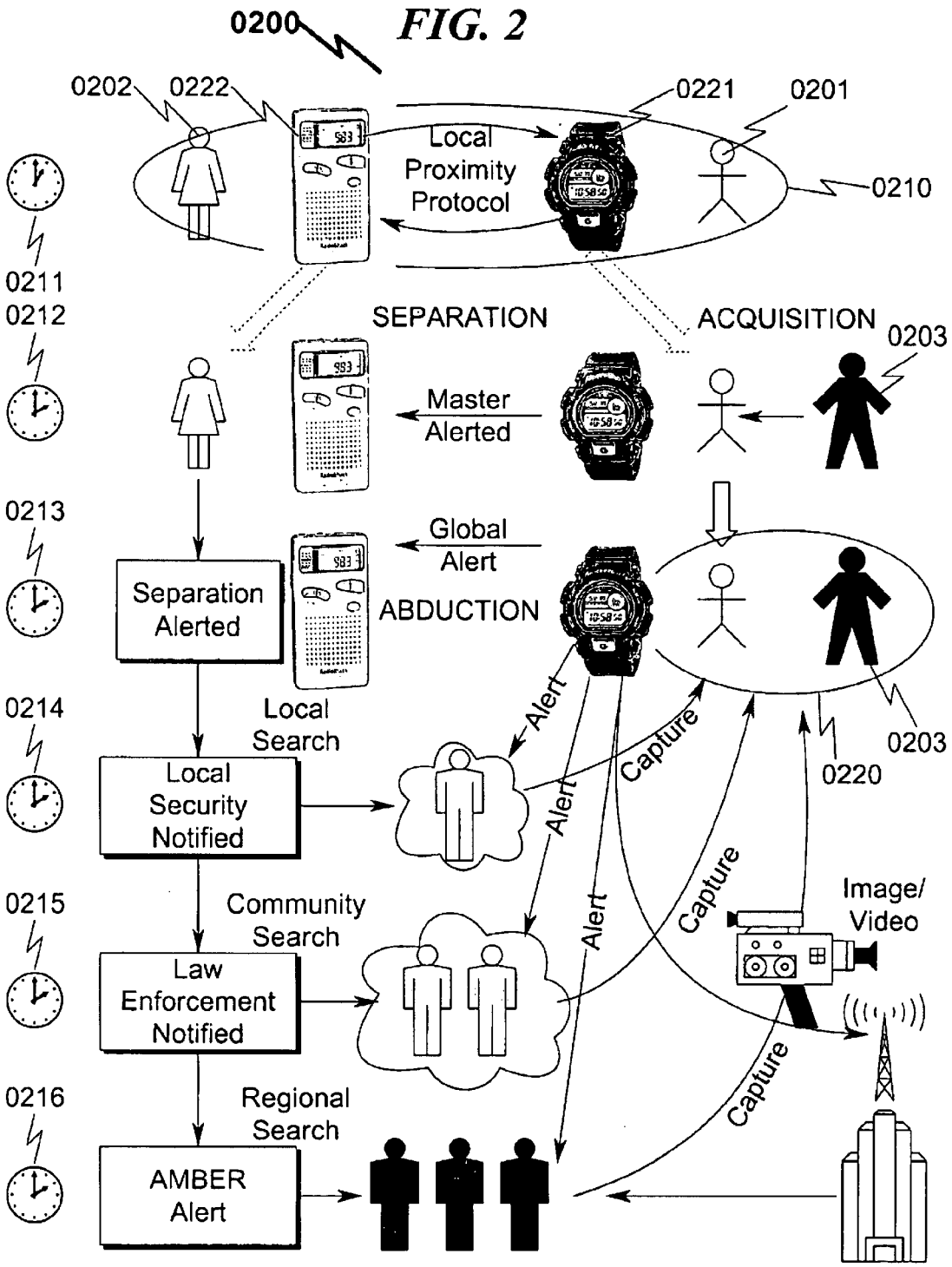
FIG. 2 illustrates an exemplary embodiment of the present invention as applied to an anti-abduction system.

The present invention as generally illustrated in FIG. 2 (0200) consists of a slave target (0201) that has in their possession a slave transceiver (0221) which communicates with a corresponding master transceiver (0222) that is possessed by a master monitor (0202). Generally, it is assumed that the master monitor (0202) and the slave target (0201) have as their goal a defined local proximity safety distance region (0210) to be maintained to ensure the safety of the slave target from potential abduction threats.

Referring to FIG. 2 (0200), the slave transceiver (0221) and master transceiver (0222) communicate using a low power local proximity protocol which defines the local proximity safety distance region (0210). This protocol serves to verify the distance between the master monitor (0202) and the slave target (0201) and also minimizes the amount of power required for the slave transceiver (0221) operation.

If the slave target (0201) and master monitor (0202) are separated due to acquisition of the slave target (0201) by a potential abductor (0203), the master transceiver (0222) is notified by the loss of transmission contact with the slave transceiver (0221). Additionally, it is anticipated that the slave transceiver (0221) will incorporate a "PANIC" button permitting the slave target (0201) to manually notify the master transceiver (0222) using a high power transmission that an emergency situation has been detected, such as a potential abduction.

Once the master monitor (0222) is notified of the separation of the slave target (0201), an escalating set of notifications may be generated by the slave transceiver (0201) using protocols directed towards local security officials, law enforcement, and eventually a nationwide alert system such as the AMBER alert network. Note that these protocols may include unique identification information that incorporates a serial number for the slave transceiver (0221) that uniquely identifies the slave target (0201). Additionally, some embodiments of the present invention may incorporate imaging and/or video that may permit pictures, sound and other information to be transmitted to law enforcement to enable these officials to track and/or locate the slave target (0201).

One potential issue that may occur with the slave transceiver (0221) is that is may be removed from the slave target (0201) prior to or during the abduction process. This situation may be addressed by incorporating a "heartbeat monitor" in the slave transceiver (0221). This "heartbeat monitor" monitors the heart rate of the slave target (0201) and reports an alert condition should the heart rate drop to zero or become unreadable. In this way, should the slave transceiver be detected by the abductor, the master monitor will be immediately notified of any attempt to tamper with the slave transceiver (0221).

Exemplary System Components (0300)

Figure 3:
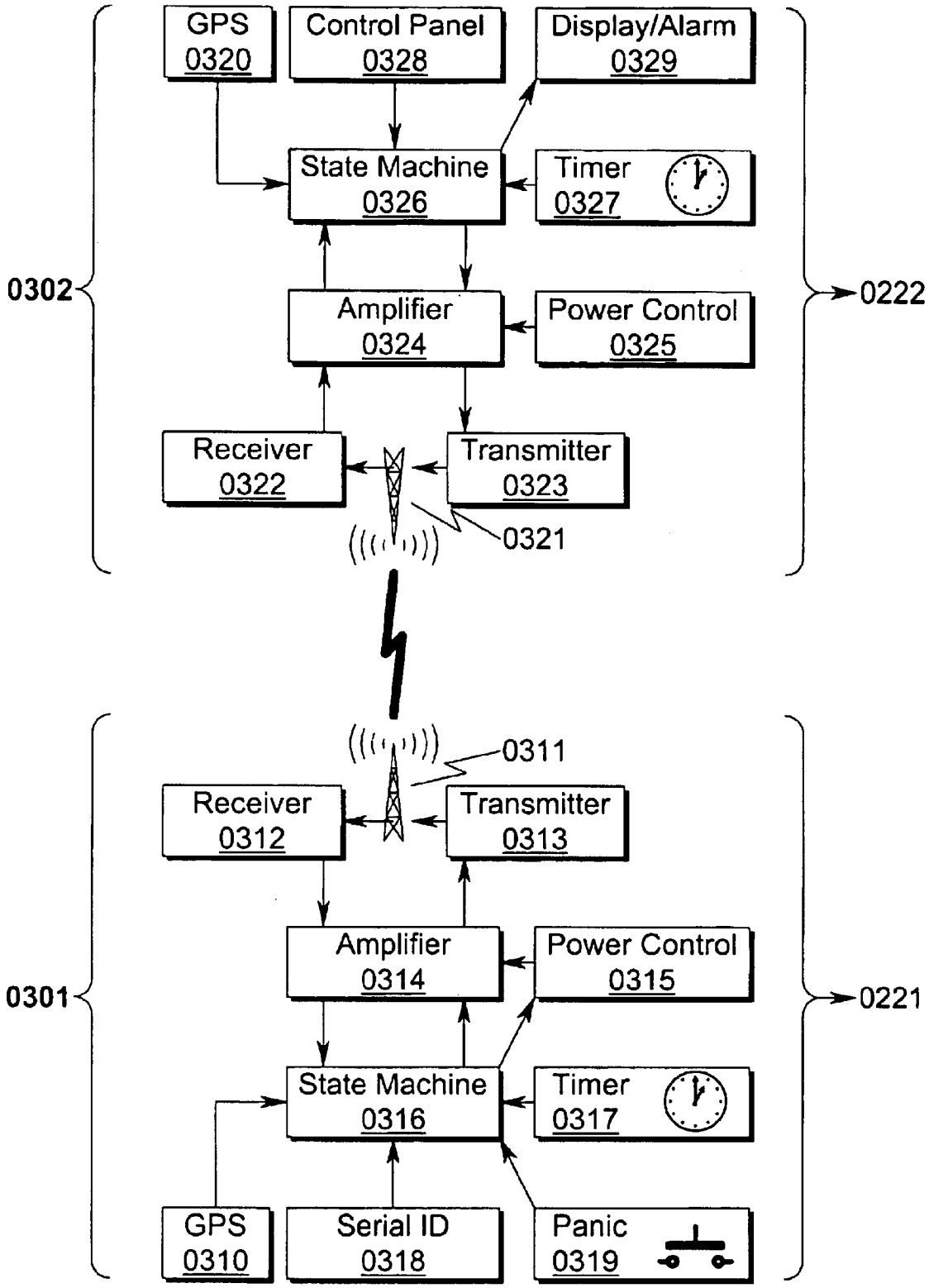
FIG. 3 illustrates a exemplary system components associated with some preferred embodiments of the present invention.

As illustrated generally in FIG. 3 (0300), the present invention may be implemented in some embodiments utilizing subsystems for the slave transceiver (0221) detailed in (0301) and master transceiver (0222) detailed in (0302). These systems will now be discussed in detail.

Referencing FIG. 3, the slave transceiver embodiment (0301) incorporates an antenna (0311) connected to a radio-frequency (RF) receiver (0312) and transmitter (0313) which have amplifiers (0314) that are capable of a variety of power amplification levels (0315). The slave transceiver is generally under control of a state machine (0316) that may be embodied in a variety of forms, including but not limited to the use of a microprocessor or microcontroller. A timer (0317) permits state machine timing and permits transitions between states depending on presence/absence of communication to the master transceiver. The slave transceiver also incorporates a unique serial number ID (0318) which may be interrogated or broadcast to either the master transceiver or law enforcement for tracking/locating purposes. Additionally, the slave transceiver may be equipped with a panic button (0319) and associated logic to permit emergency transmission of information (possibly including audio, video, or photographs) to the master transceiver and/or law enforcement in the event that the slave target detects a potential abduction or other emergency event. Finally, the slave transceiver may optionally be outfitted with a GPS receiver (0310) that will permit GPS information to be broadcast to the master transceiver and/or law enforcement for tracking and/or locating purposes.

Referencing FIG. 3, the master transceiver embodiment (0302) closely matches that of the slave transceiver (0301), and in some embodiments may be virtually identical with minor changes in software programming. Other embodiments may be custom and incorporate additional features not incorporated in the slave transceiver. The master transceiver (0302) incorporates an antenna (0321) connected to a radio-frequency (RF) receiver (0322) and transmitter (0323) which have amplifiers (0324) that are capable of a variety of power amplification levels (0325). The master transceiver is generally under control of a state machine (0326) that may be embodied in a variety of forms, including but not limited to the use of a microprocessor or microcontroller. A timer (0327) permits state machine timing and permits transitions between states depending on presence/absence of communication to the slave transceiver. The master transceiver also incorporates a control panel (0328) which may be used to configure/control the master transceiver. Additionally, the master transceiver may be equipped with a display/alarm (0329) features and associated logic to permit emergency transmission of information (possibly including audio, video, or photographs) to the master transceiver and/or law enforcement in the event that the slave target detects a potential abduction or other emergency event. Finally, the master transceiver may optionally be outfitted with a GPS receiver (0320) that will permit GPS information to be used to accurately determine the distance (and position) of the master transceiver in relation to the slave transceiver. This information can then be used to reacquire the slave target or to provide information to law enforcement for their acquisition of the slave target.

Spatial Safety Zones (0400)

Figure 4:
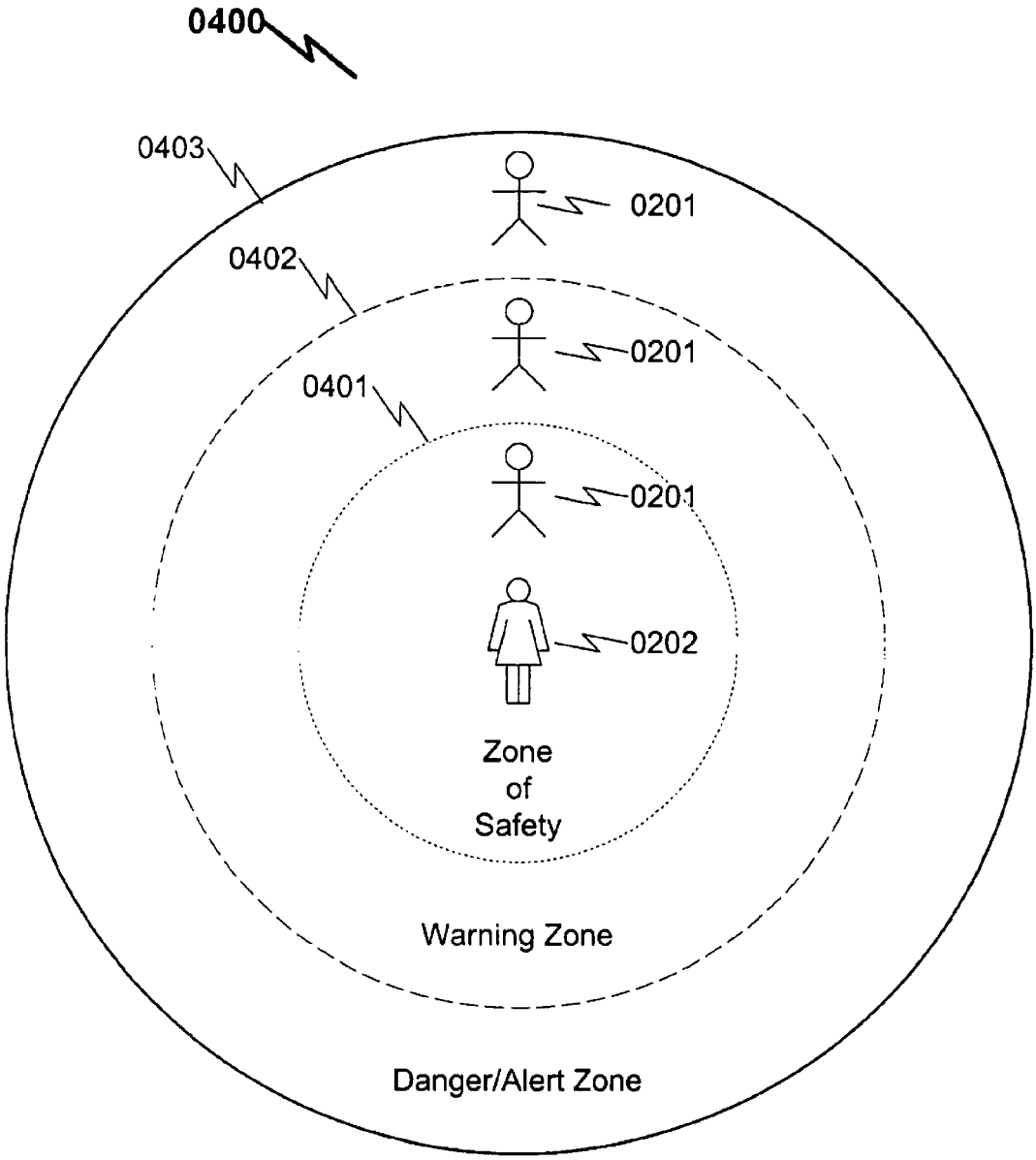
FIG. 4 illustrates a exemplary safety zones associated with some preferred embodiments of the present invention.

As illustrated generally in FIG. 4 (0400), the present invention incorporates modulated power transmissions between the slave transceiver and the master transceiver to determine the spatial distance between the slave target (0201) and the master monitor (0202). This permits the master monitor to determine a "zone of safety" (0401) wherein the slave target (0201) is determined to be in safe proximity to the master monitor (0202). As the slave target moves outside the "zone of safety" (0401), the master monitor may be notified with increasingly urgent messages that the slave target (0201) has transgressed into the "warning zone" (0402) or the "danger/alert zone" (0403). One skilled in the art will recognize that the spatial thresholds for these and other zones may be set arbitrarily and may be a programming feature of the master transceiver.

GPS Enhanced Embodiment (0500)

Figure 5:
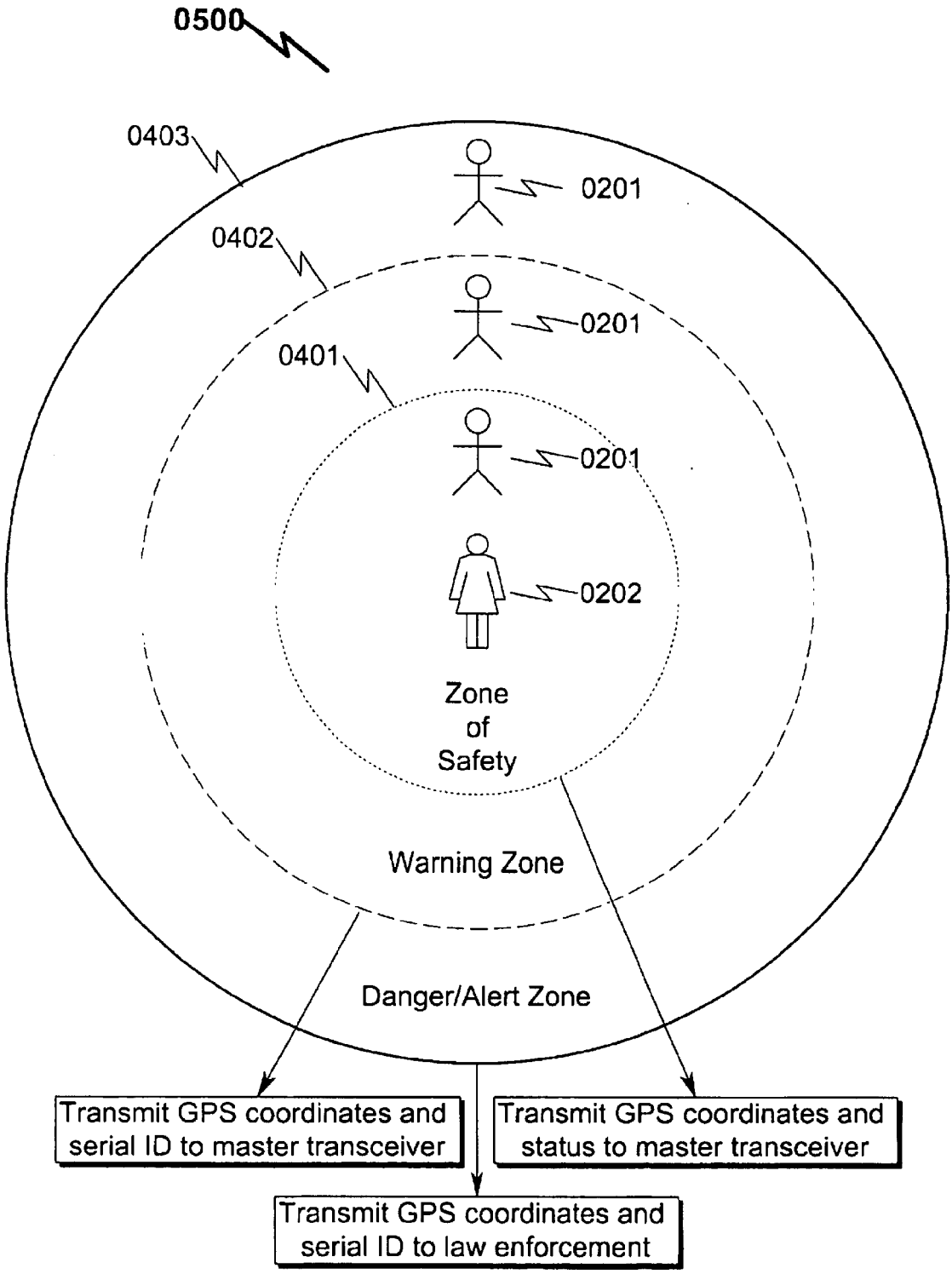
FIG. 5 illustrates an exemplary GPS enhanced embodiment of the present invention.

The present invention as illustrated in FIG. 2 (0200) generally utilizes variations in transceiver transmission power to determine the distance between the master monitor and the slave target. However, one preferred embodiment as illustrated in FIG. 5 (0500) utilizes Global Positioning System (GPS) receivers in both the slave transceiver and the master transceiver to determine precisely the location of the slave target and the master monitor with respect to each other.

This GPS augmentation permits a more refined threshold of separation warning between the slave target and the master monitor, by optionally providing gradations of warning based on the distance between these entities. These enhancements may permit a series of small warnings to the master monitor as the separation distance is increased progressing towards a full blown alert once the maximum safety distance has been exceeded.

Additionally, the incorporation of GPS in this enhanced embodiment permits tracking of the slave transceiver once the maximum safety distance has been exceeded. Thus, the master monitor or security/law enforcement may use the master transceiver (or an appropriately configured law enforcement transceiver) to track the slave transceiver once an abduction scenario has been confirmed. This ability to track the slave transceiver by law enforcement, coupled with the broadcast capability of the slave transceiver opens up the possibility of independent tracking of the slave transceiver by mobile law enforcement units once an abduction scenario is confirmed.

This situation may take the following form. Once the master monitor determines that separation has occurred, it may be possible for the master transceiver to broadcast the serial number ID of the slave transceiver to police authorities, who could automatically relay this information to all available mobile law enforcement transceivers. This permits instant mobilization of a tracking network among law enforcement with automatic tracking enabled to permit rapid recovery of the slave target. Additionally, high power broadcasts of the GPS location and serial number ID of the slave transceiver also open the door to rapid identification of the slave target as an abductee as well as rapid recovery of same by properly equipped law enforcement.

Exemplary Method Embodiment (0600)

Figure 6:
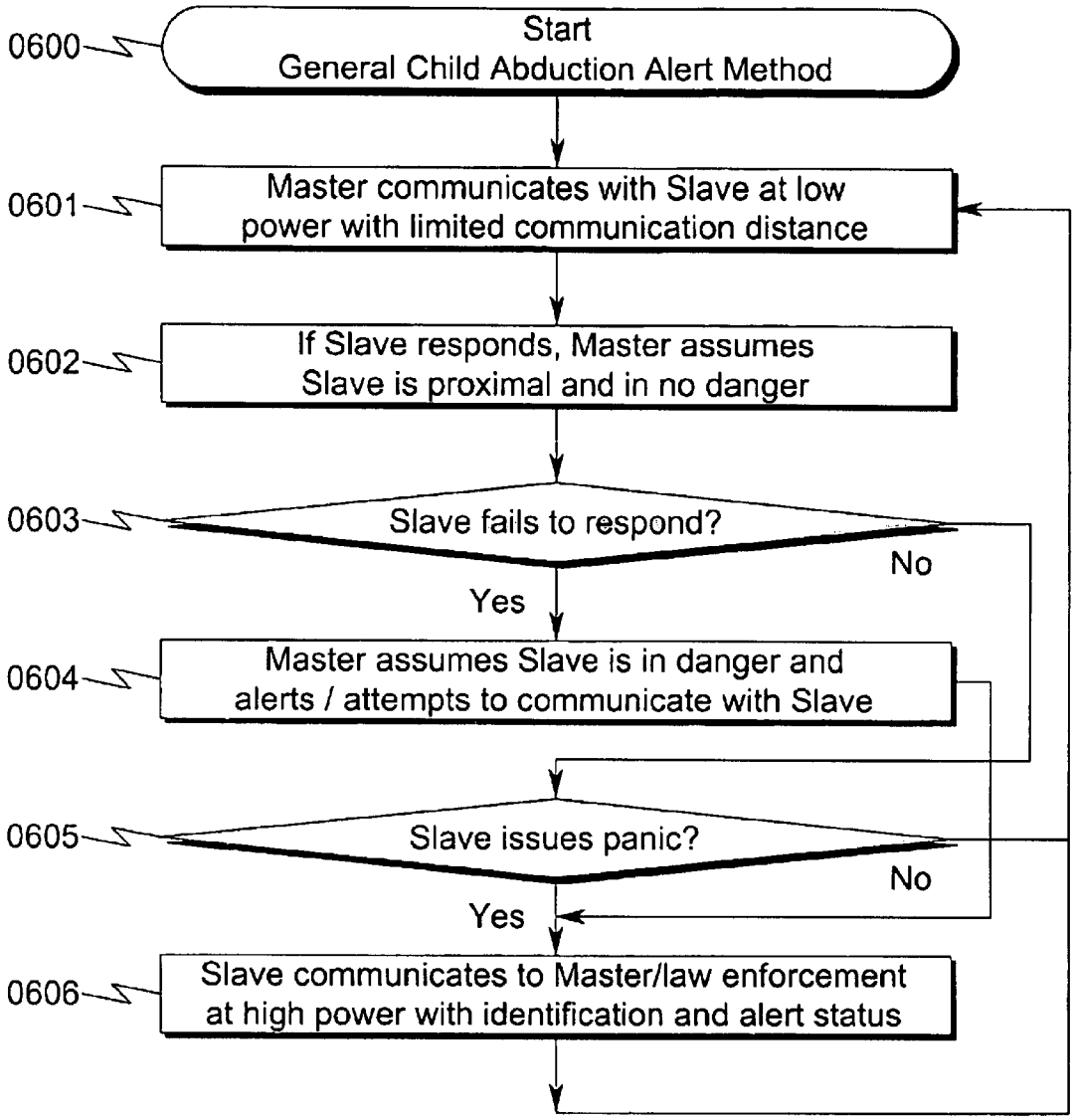
FIG. 6 illustrates an exemplary general child abduction alert method.

The present invention teaches a generalized anti-abduction method which is generally illustrated in FIG. 6 (0600) and includes the following steps:

1. the master transceiver communicates with the slave transceiver at low power with limited communication distance (0601);
2. if the slave transceiver responds, the master assumes that the slave transceiver (and slave target) are proximal, and there is no danger (0602);
3. if the slave responds (0603), control passes to step (5);
4. otherwise, the master assumes that the slave is in danger and alerts the master transceiver which attempts to reestablish communications with the slave transceiver (0604), with control passing to step (6);
5. if the slave has not issued a panic alert (0605), control passes to step (1);
6. otherwise, the slave transceiver communicates with the master transceiver and/or law enforcement at high power with serial number identification information and alert status (0606), with control passing to step (1).

At the end of this procedure, the slave target is either reacquired by law enforcement or information is provided to law enforcement to indicate the status of the slave transceiver.

One skilled in the art will recognize that these steps may in some circumstances be rearranged with no loss of function with respect to application in the field of anti-abduction techniques.

Exemplary State Machine (0700)

Figure 7:
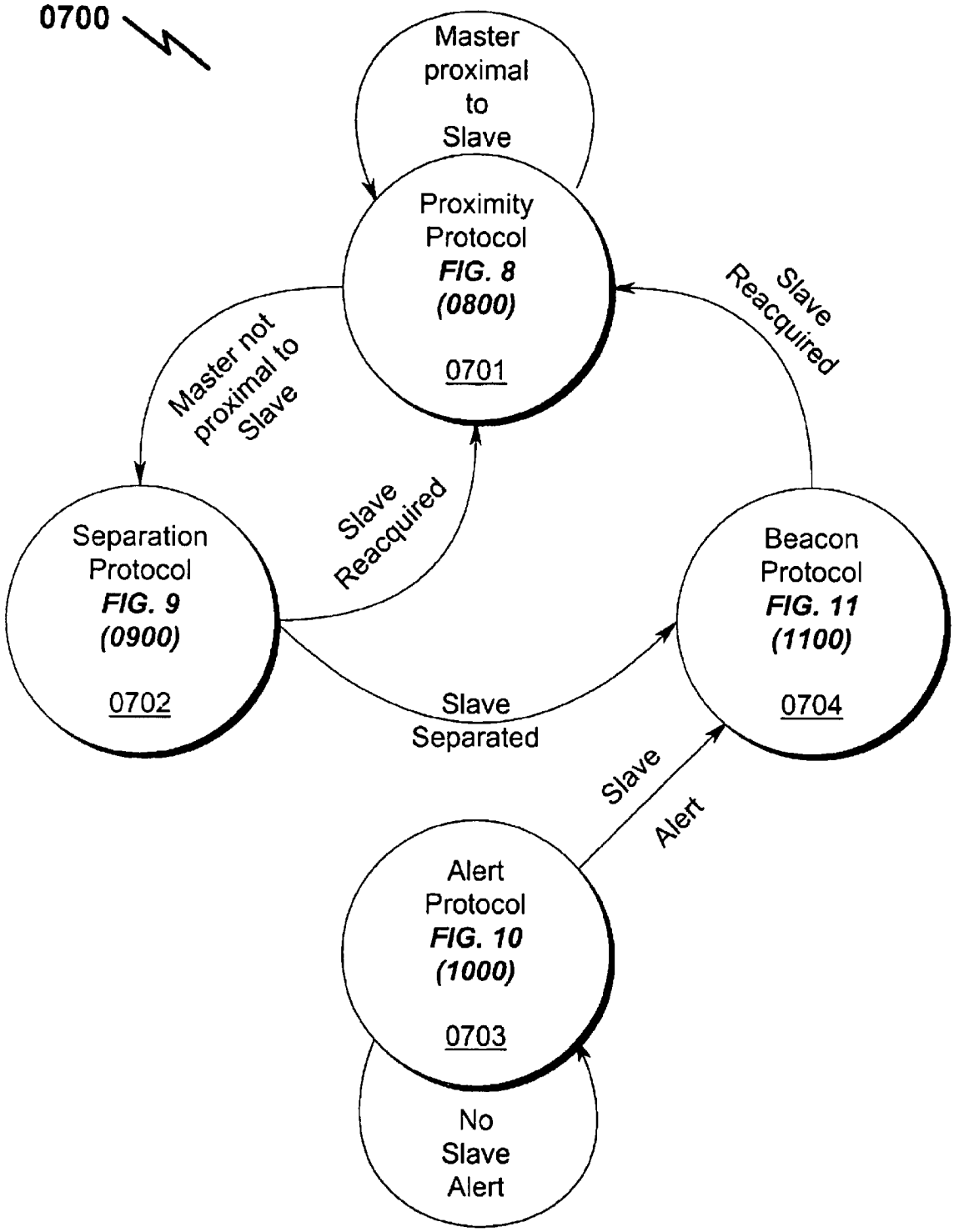
FIG. 7 illustrates an exemplary state transition diagram associated with the teachings of the present invention.

The present invention may be exemplified by the state machine illustrated in FIG. 7 (0700) and includes the following states:

1. Proximity Protocol (0701), wherein the master transceiver is proximal to the slave transceiver. This protocol is further detailed in FIG. 8 (0800).
2. Separation Protocol (0702), wherein the master transceiver is separated from the slave transceiver.

Figure 9:
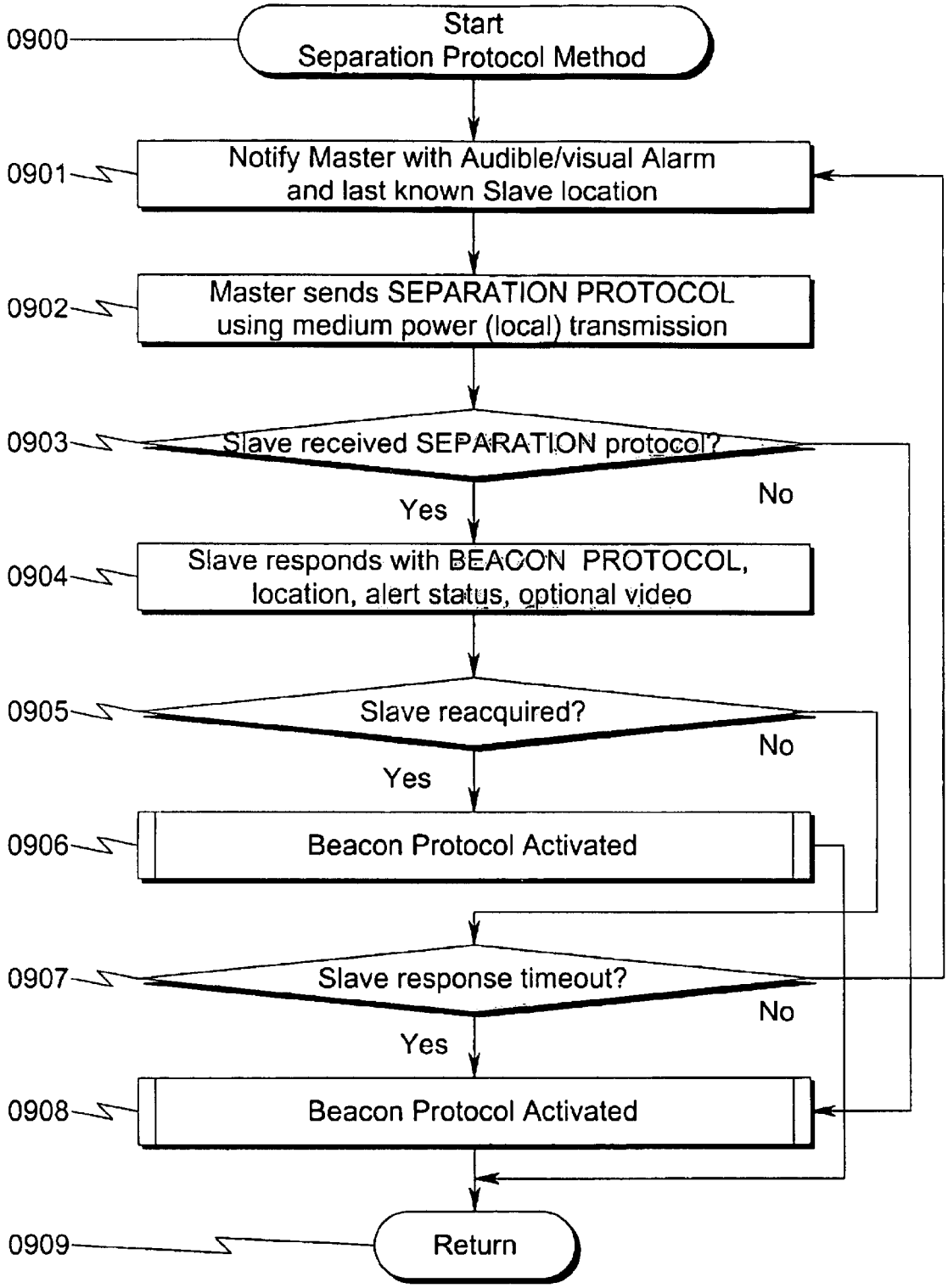
FIG. 9 illustrates an exemplary separation protocol method useful in some preferred embodiments of the present invention.

This protocol is detailed further in FIG. 9 (0900).

3. Alert Protocol (0703), wherein the slave transceiver issues an alert message to the master transceiver or law enforcement. This protocol is detailed further in FIG. 10 (1000).
4. Beacon Protocol (0704), wherein the slave transceiver issues beacon messages in order to be reacquired by either the master transceiver or law enforcement. This protocol is detailed further in FIG. 11 (1100).

These exemplary protocol methods will now be discussed in detail.

Exemplary Proximity Protocol Method (0800)

Figure 8:
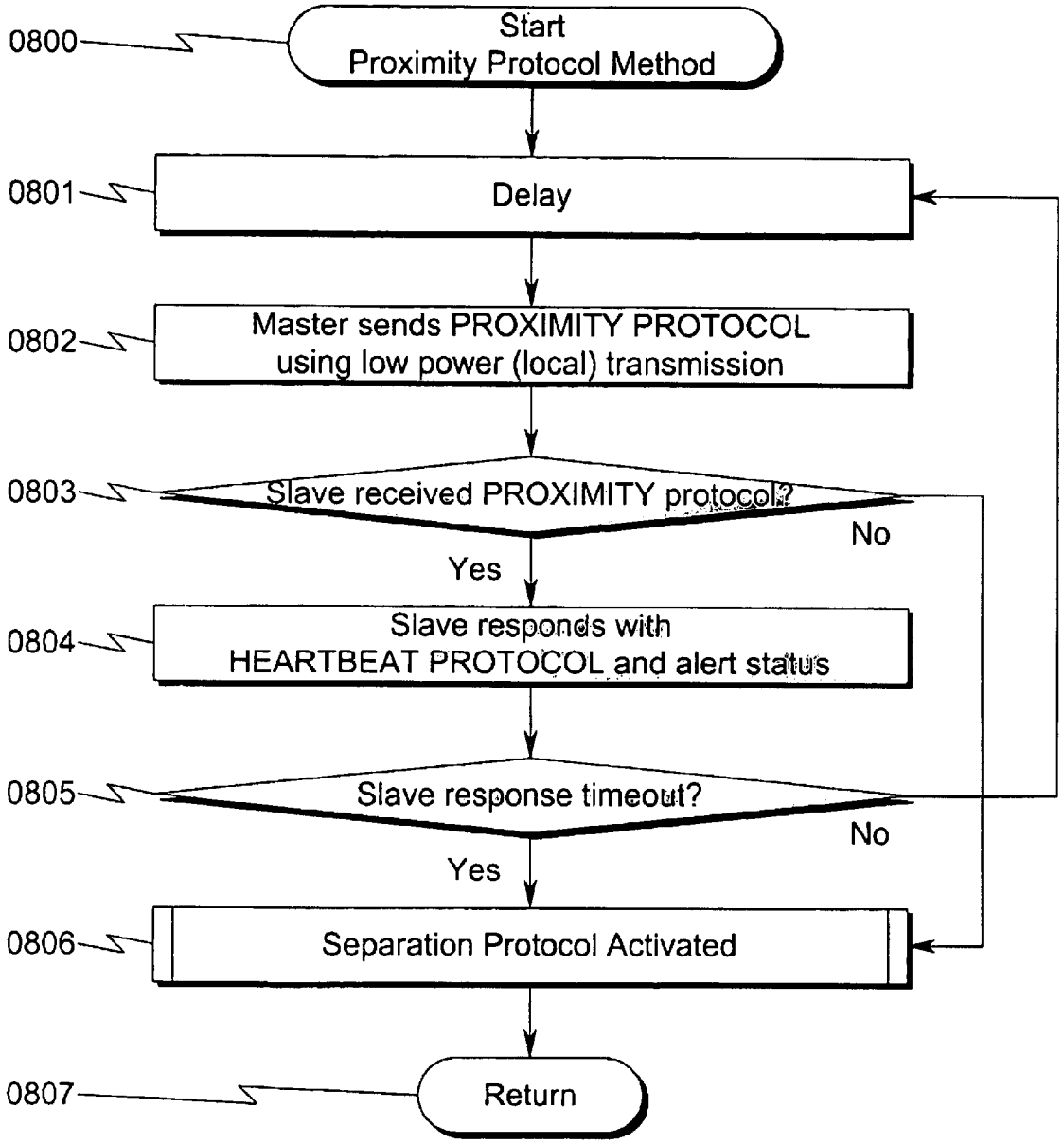
FIG. 8 illustrates an exemplary proximity protocol method useful in some preferred embodiments of the present invention.

The present invention teaches a generalized proximity protocol method which is generally illustrated in FIG. 8 (0800) and includes the following steps:

1. a time delay is activated (0801);
2. the master transceiver sends a proximity protocol message to the slave transceiver using low power (local) transmission (0802);
3. if the slave does not respond to the proximity protocol message, control passes to step (6) (0803);
4. the slave transceiver responds with a heartbeat protocol and an alert status (0804);
5. if the slave response does not time out, control passes to step (1) (0805);
6. otherwise, the separation protocol is activated (0806).

One skilled in the art will recognize that these steps may in some circumstances be rearranged with no loss of function with respect to application in the field of anti-abduction techniques.

Exemplary Separation Protocol Method (0900)

The present invention teaches a generalized separation protocol method which is generally illustrated in FIG. 9 (0900) and includes the following steps:

1. the master transceiver is notified with an audible/visual alarm and the last known slave transceiver location (0901);
2. the master transceiver sends a separation protocol using medium power (local) transmission (0902);
3. if the slave does not receive the separation protocol message, control passes to step (7) (0903);
4. the slave transceiver responds with a beacon protocol, current location, alert status, and optional audio/video/picture information (0904);
5. if the slave transceiver is not reacquired, control passes to step (7) (0905);
6. otherwise, the beacon protocol is activated (0906);

7. if the slave transceiver response does not time out, control passes to step (1) (0907);
8. the beacon protocol is activated (0908).

One skilled in the art will recognize that these steps may in some circumstances be rearranged with no loss of function with respect to application in the field of anti-abduction techniques.

Exemplary Alert Protocol Method (1000)

Figure 10:
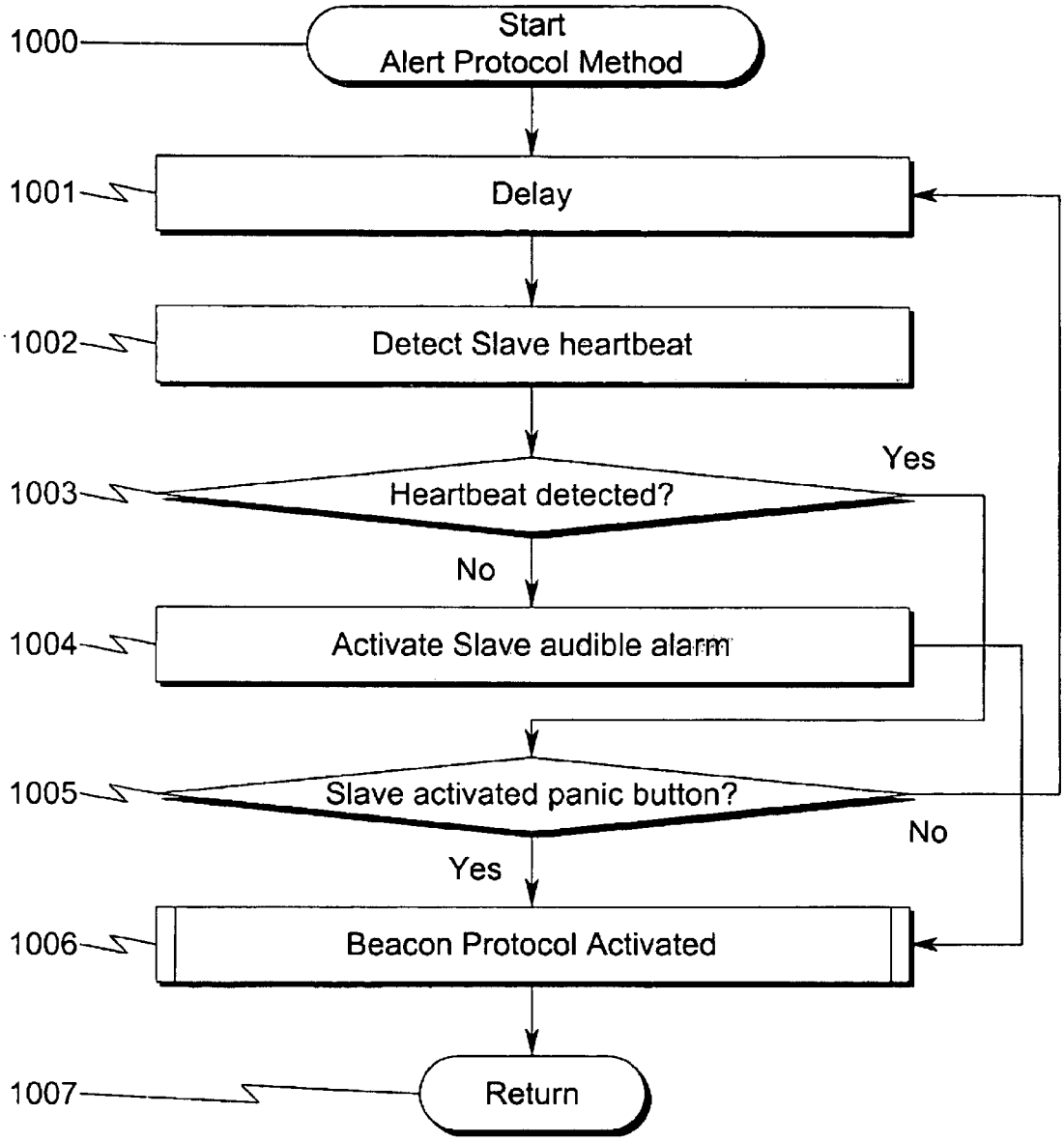
FIG. 10 illustrates an exemplary alert protocol method useful in some embodiments of the present invention.

The present invention teaches a generalized alert protocol method which is generally illustrated in FIG. 10 (1000) and includes the following steps:

1. a time delay is activated (1001);
2. the slave transceiver detects the slave target heartbeat (1002);
3. if the slave target has a heartbeat, control passes to step (5) (1003);
4. otherwise, a slave transceiver audible alarm is activated, and control passes to step (6) (1004);
5. if the slave target has not activated the panic button, control passes to step (1) (1005);
6. otherwise, the beacon protocol is activated (1006).

One skilled in the art-will recognize that these steps may in some circumstances be rearranged with no loss of function with respect to application in the field of anti-abduction techniques.

Exemplary Beacon Protocol Method (1100)

Figure 11:
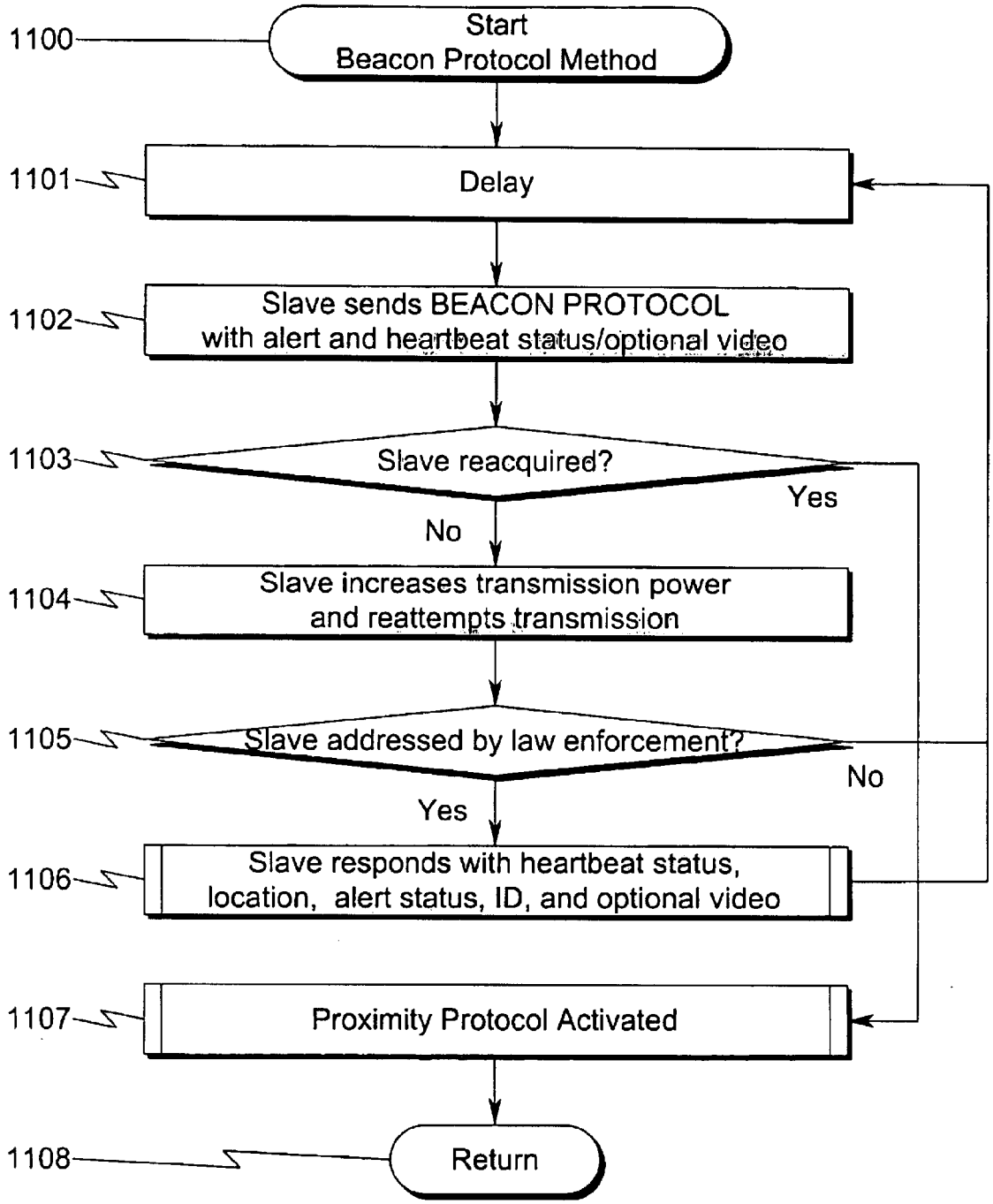
FIG. 11 illustrates an exemplary beacon protocol method useful in some embodiments of the present invention.

The present invention teaches a generalized beacon protocol method which is generally illustrated in FIG. 11 (1100) and includes the following steps:

1. a time delay is activated (1101);
2. the slave transceiver transmits a beacon protocol with alert status, heartbeat status, and optional audio/video/pictures (1102);
3. if the slave target is reacquired, control passes to step (7) (1103);
4. otherwise, the slave transceiver increases transmission power and attempts retransmission (1104);
5. if the slave transceiver is not addressed by law enforcement, control passes to step (1) (1105);
6. otherwise, the slave transceiver responds with heartbeat status, location, alert status, identification, and optional audio/video/pictures and returns control to step (1) (1006);
7. the proximity protocol is activated (1107).

One skilled in the art will recognize that these steps may in some circumstances be rearranged with no loss of function with respect to application in the field of anti-abduction techniques.

Alternative System Form Factor (1200)

Figure 12:
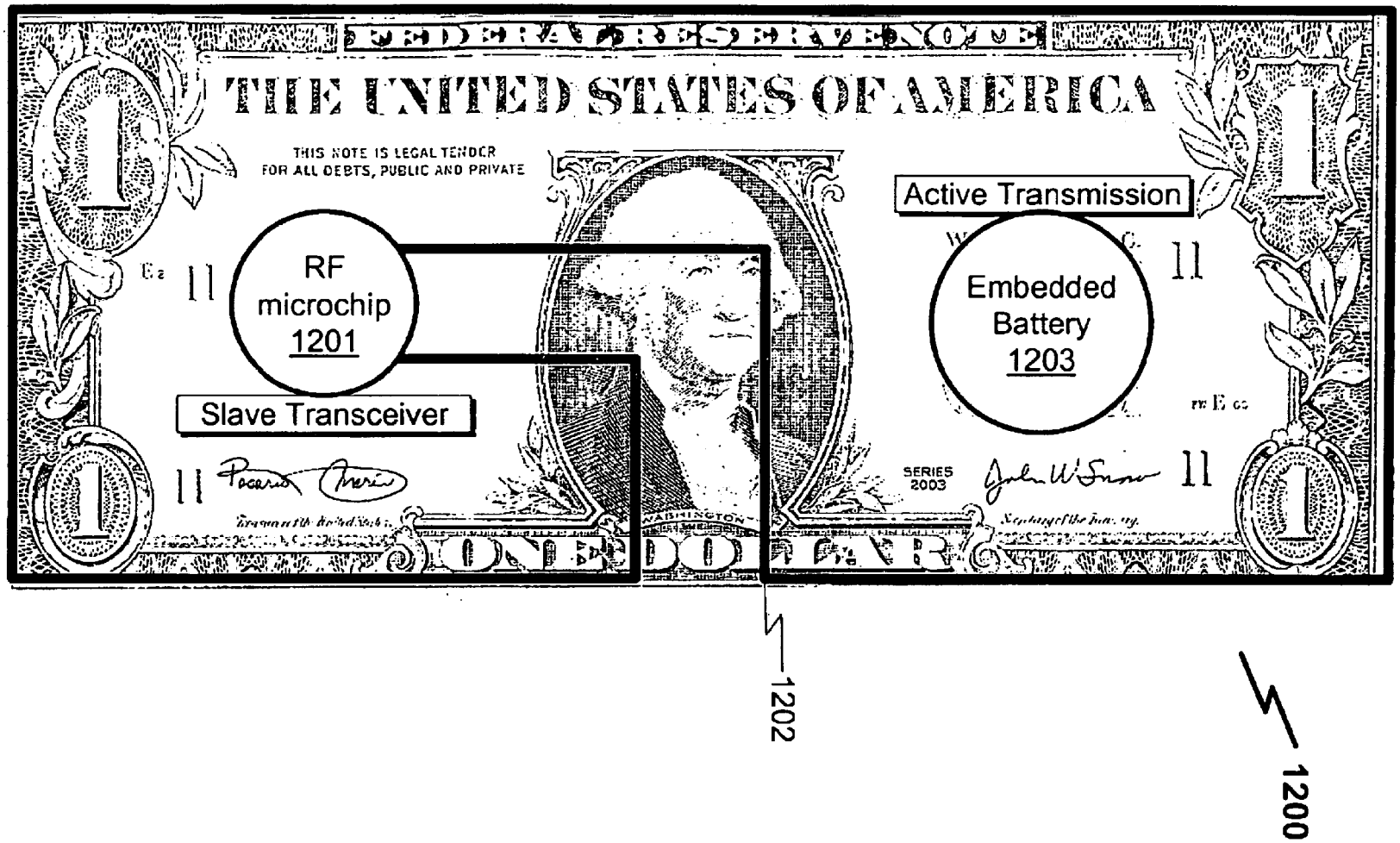
FIG. 12 illustrates an alternative form factor for the slave tranceiver useful in some embodiments of the present invention.

One preferred embodiment of the slave transceiver may take the form of U.S. or other currency as illustrated in FIG. 12 (1200). Here the currency may incorporate a radio frequency (RF) microchip (1201) constituting the active portion of the slave transceiver, along with metallic wires/fibers in the periphery of the currency constituting the passive antenna (1202). This embodiment may also incorporate a thin-film lithium or other chemistry battery (1203) used to power the system, although some embodiments may utilize RF microchips which extract power from the antenna for use in operating the slave transceiver functions.

While this embodiment may not incorporate the range or level of features as a fully powered slave transceiver that has access to significant power resources, it does have a small form factor and can be easily transported by the slave target with little possibility of detection by a potential kidnapper or abductor.

System/Method Applications

The present invention anticipates a wide variety of applications for both the disclosed system and method. These include but are not limited to the following:

The present invention is particularly well suited for situations in which children must be protected from abduction and/or kidnapping. This preventative measure can be incorporated into shopping settings, schools, and other environments where children are typically abducted.

As an anti-terrorism device, the present invention may be used in hostile environments where individuals are at risk for kidnapping. This might also include government officials who are likely to be kidnapped and/or lost during covert operations outside the United States.

The slave transceiver may be incorporated into handbags and other articles that are susceptible to theft, providing an easy mechanism to determine the event of their theft as well as provide a means of recovery by law enforcement.

One skilled in the art will not doubt find other applications for the teachings of the present invention and its preferred embodiments.

System Variations

The present invention anticipates a wide variety of variations in the basic theme of construction. The examples presented previously do not represent the entire scope of possible usages. They are meant to cite a few of the almost limitless possibilities.

CONCLUSION

An anti-abduction system and method has been disclosed which utilizes a radio frequency transceiver attached to a slave to communicate with a corresponding master transceiver to detect and prevent abductions, which may be advantageously applied to situations in which child abduction is a possibility. The disclosed system and method utilizes communication protocols to notify the master of the proximal locality of the slave unit and any spatial deviation of the slave from the master.

Utilization of varying strength transceiver signaling between the master and slave permits the distance between the master and slave to be approximated. Additionally the slave may contain an optional heartbeat monitor to detect and report situations in which the device is removed from the potential abduction victim. The present invention may be generally targeted towards preventing child abductions, but has applications as an anti-terrorist device in preventing kidnappings of political persons and other innocents by terrorist groups and the like.

Although a preferred embodiment of the present invention has been illustrated in the accompanying drawings and described in the foregoing Detailed Description, it will be understood that the invention is not limited to the embodiments disclosed, but is capable of numerous rearrangements, modifications, and substitutions without departing from the spirit of the invention as set forth and defined by the following claims.

What is claimed is:

1. An anti-abduction system comprising:

(a) a master transceiver, which may be proximal to a monitor;

(b) a slave transceiver, which may be attached to a potential abductee;

wherein said master transceiver communicates with said slave transceiver utilizing varying degrees of power transmission to determine the spatial proximity of said slave to said master;

said master transceiver is notified when communication with said slave transceiver is disrupted;

said slave transceiver has a unique identification code which is broadcasted at high power if said communication is disrupted with said master transceiver.

2. The anti-abduction system of claim 1 wherein said slave transceiver is packaged in a wristwatch.

3. The anti-abduction system of claim 1 wherein said slave transceiver is packaged in the form of a pendant.

4. The anti-abduction system of claim 1 wherein said slave transceiver is packaged in the form of paper currency.

5. The anti-abduction system of claim 1 wherein said slave transceiver further comprises a heartbeat monitor.

6. The anti-abduction system of claim 1 wherein said slave transceiver notifies said master transceiver of any loss in abductee heartbeat.

7. The anti-abduction system of claim 1 wherein said slave transceiver transmits audio information to said master transceiver.

8. The anti-abduction system of claim 1 wherein said slave transceiver transmits a video image to said master transceiver.

9. The anti-abduction system of claim 1 wherein said slave transceiver transmits a digital image to said master transceiver.

10. The anti-abduction system of claim 1 wherein said slave transceiver transmits GPS location information to said master transceiver.

11. An anti-abduction method comprising:

(1) a master transceiver communicating with a slave transceiver at low power with limited communication distance;

(2) it said slave transceiver responds, said master transceiver assuming said slave is proximal to said master and in no danger;

(3) if said slave responds to said master, proceeding to step (5).

(4) otherwise, said master assumes said slave is in danger and said master attempts to communicate with said slave, then proceeds to step (6);

(5) if said slave issues a panic alert, then proceeding to step (6), otherwise proceeding to step (1);

(6) said slave communicating to said master and/or law enforcement at high transmission power with identification to indicate an alert status, and then proceeding to step (1).

12. The anti-abduction method of claim 11 wherein said slave transceiver is packaged in a wristwatch.

13. The anti-abduction method of claim 11 wherein said slave transceiver is packaged in the form of a pendant.

14. The anti-abduction method of claim 11 wherein said slave transceiver is packaged in the form of paper currency.

15. The anti-abduction method of claim 11 wherein said slave transceiver further comprises a heartbeat monitor.

16. The anti-abduction method of claim 11 wherein said slave transceiver notifies said master transceiver of any loss in abductee heartbeat.

17. The anti-abduction method of claim 11 wherein said slave transceiver transmits audio information to said master transceiver.

18. The anti-abduction method of claim 11 wherein said slave transceiver transmits a video image to said master transceiver.

19. The anti-abduction method of claim 11 wherein said slave transceiver transmits a digital image to said master transceiver.

20. The anti-abduction method of claim 11 wherein said slave transceiver transmits GPS location information to said master transceiver.

* * * * *